US010428623B2

(12) United States Patent
Silva

(10) Patent No.: US 10,428,623 B2
(45) Date of Patent: Oct. 1, 2019

(54) BALL DROPPING SYSTEM AND METHOD

(71) Applicant: Zachary Silva, Houston, TX (US)

(72) Inventor: Zachary Silva, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 268 days.

(21) Appl. No.: 15/340,569

(22) Filed: Nov. 1, 2016

(65) Prior Publication Data

US 2018/0119521 A1 May 3, 2018

(51) Int. Cl.
*E21B 23/04* (2006.01)
*E21B 41/00* (2006.01)
*E21B 43/26* (2006.01)

(52) U.S. Cl.
CPC ..... *E21B 41/00* (2013.01); *E21B 23/04* (2013.01); *E21B 43/26* (2013.01)

(58) Field of Classification Search
CPC ..... E21B 23/04
See application file for complete search history.

(56) References Cited

U.S. PATENT DOCUMENTS 4,637,468 A 1/1987 Derrick
5,180,009 A 1/1993 Sneed
5,335,727 A * 8/1994 Cornette ..... E21B 17/1014 166/120
6,012,525 A 1/2000 Burleson et al.
6,155,350 A 12/2000 Melenyzer
6,220,360 B1 4/2001 Connell et al.
6,390,200 B1 5/2002 Allamon et al.
6,776,228 B2 8/2004 Pedersen et al.
6,802,372 B2 * 10/2004 Budde ..... E21B 34/14 166/193
6,959,766 B2 11/2005 Connell
7,100,700 B2 9/2006 Davis et al.
(Continued)

FOREIGN PATENT DOCUMENTS

WO 2014099206 A1 6/2014
WO 2015038095 A1 3/2015
(Continued)

OTHER PUBLICATIONS

International Search Report for International Application No. PCT/US2017/053992; dated Dec. 15, 2017; 4 pages.
(Continued)

*Primary Examiner* — Robert E Fuller
(74) *Attorney, Agent, or Firm* — Cantor Colburn LLP

(57) ABSTRACT

A ball dropping system includes a ball retention feature. The ball retention feature includes an ejection arrangement blocked from activating in a first condition of the ball dropping system, activatable in a second condition of the ball dropping system, and activated to eject a ball from the ball dropping system that is releasably secured by the ball retention feature in a third condition of the ball dropping system. A setting sleeve is movable from a first position to a second position with respect to the ejection arrangement. The setting sleeve has the first position to block the ejection arrangement from activating in the first condition of the ball dropping system. The setting sleeve is movable to the second position to render the ejection arrangement activatable in the second condition of the ball dropping system.

21 Claims, 11 Drawing Sheets

(56) References Cited

U.S. PATENT DOCUMENTS

| | | | |
|---|---|---|---|
| 7,273,096 | B2 | 9/2007 | Den Boer et al. |
| 7,624,810 | B2 | 12/2009 | Fould et al. |
| 7,703,523 | B2 | 4/2010 | Wardley |
| 7,770,652 | B2 | 8/2010 | Barnett |
| 7,779,926 | B2 | 8/2010 | Turley et al. |
| 8,091,628 | B2 | 1/2012 | Peer et al. |
| 8,950,480 | B1 | 2/2015 | Strickland |
| 8,967,269 | B2 | 3/2015 | Xu |
| 2004/0055753 | A1 | 3/2004 | Davis et al. |
| 2005/0072577 | A1 | 4/2005 | Freeman |
| 2005/0241834 | A1 | 11/2005 | McGlothen et al. |
| 2005/0241835 | A1 | 11/2005 | Burris, II et al. |
| 2009/0159297 | A1 | 6/2009 | Fould et al. |
| 2011/0135953 | A1 | 6/2011 | Xu et al. |
| 2011/0278017 | A1 | 11/2011 | Themig et al. |
| 2012/0048562 | A1 | 3/2012 | Zimmerman et al. |
| 2013/0062055 | A1 | 3/2013 | Tolman et al. |
| 2013/0175053 | A1 | 7/2013 | Madero et al. |
| 2013/0192846 | A1 | 8/2013 | Garcia et al. |
| 2013/0248174 | A1 | 9/2013 | Dale et al. |
| 2014/0116731 | A1 | 5/2014 | Themig et al. |
| 2014/0262312 | A1 | 9/2014 | Tilley |
| 2015/0068771 | A1 | 3/2015 | Richards et al. |
| 2015/0068772 | A1 | 3/2015 | Richards et al. |
| 2015/0136425 | A1 | 5/2015 | Burgos et al. |
| 2015/0252640 | A1 | 9/2015 | Mailand et al. |
| 2015/0252642 | A1 | 9/2015 | Mailand et al. |
| 2015/0252643 | A1 | 9/2015 | Mailand et al. |
| 2016/0061018 | A1 | 3/2016 | Ditzler |
| 2016/0123129 | A1 | 5/2016 | Sanchez et al. |
| 2016/0186514 | A1 | 6/2016 | King et al. |
| 2016/0222764 | A1 | 8/2016 | Rorvik |
| 2016/0312556 | A1 | 10/2016 | Silva et al. |
| 2017/0145781 | A1 | 5/2017 | Silva |
| 2017/0342806 | A1 | 11/2017 | Themig et al. |
| 2018/0030807 | A1 | 2/2018 | Martin et al. |

FOREIGN PATENT DOCUMENTS

| | | | |
|---|---|---|---|
| WO | 2015038096 | A1 | 3/2015 |
| WO | 2015084342 | A1 | 6/2015 |
| WO | 2015138254 | A1 | 9/2015 |

OTHER PUBLICATIONS

Written Opinion of the International Search Report for International Application No. PCT/US2017/053992; dated Dec. 15, 2017; 7 pages.

Baker Hughes; http://blogs.bakerhughes.com; "Completion techniques in shale reservoirs", Baker Hughes Reservoir Blog, Sep. 18, 2010, 2 Pages.

International Search Report and Written Opinion for International Application No. PCT/US15/062409; dated Jun. 23, 2016; 10 pages.

International Search Report for International Application No. PCT/US2012/067732; dated Mar. 19, 2013; 3 pages.

Written Opinion of the International Search Report for International Application No. PCT/US2012/067732; dated Mar. 19, 2013, 6 pages.

* cited by examiner

BALL DROPPING SYSTEM AND METHOD

BACKGROUND

In the drilling and completion industry, the formation of boreholes for the purpose of production or injection of fluid is common. The boreholes are used for exploration or extraction of natural resources such as hydrocarbons, oil, gas, water, and alternatively for CO2 sequestration.

The stimulation of unconventional resources through plug and perf operations generally follows a standardized set of operating procedures. A bottom hole assembly ("BHA"), which includes a frac plug, a wireline adapter kit ("WLAK"), a setting tool, perforating guns, and a casing collar locator ("CCL"), is pumped down to depth via wireline, the frac plug is set, and the BHA releases from the plug, perforating guns are fired, and the BHA is pulled out of hole ("POOH"), leaving the frac plug behind. After the BHA is pulled from the wellbore, a frac ball is dropped from surface and pumped to depth, until the frac ball seats on the frac plug and a pressure increase is seen. Following the frac ball seating, the frac job is performed and then this process is repeated for a number of zones.

Due to the extent that the unconventional resources market is time sensitive, it is desirable to limit the number of repetitive operations that include any down time while frac crews or wireline operators are on site. One such repetitive operation includes the dropping of frac balls from surface, however having the ball carried to depth with the frac plug presents risks if the perforating guns fail to fire. That is, with the frac ball on the frac plug and no perforations above the frac plug, the next BHA will not be able to be pumped downhole, and a coiled tubing unit must be brought to location to "push" the BHA downhole, thus requiring moving assets and down time for equipment and personnel already on site.

The art would be receptive to improved devices and method for occluding a frac plug after firing of perforating guns.

BRIEF DESCRIPTION

A ball dropping system includes a ball retention feature; an ejection arrangement blocked from activating in a first condition of the ball dropping system, activatable in a second condition of the ball dropping system, and activated to eject a ball from the ball dropping system that is releasably secured by the ball retention feature in a third condition of the ball dropping system; and, a setting sleeve movable from a first position to a second position with respect to the ejection arrangement, the setting sleeve having the first position to block the ejection arrangement from activating in the first condition of the ball dropping system, and the setting sleeve movable to the second position to render the ejection arrangement activatable in the second condition of the ball dropping system.

A downhole assembly includes a frac plug configured to receive a ball; a setting tool configured to set the frac plug within an outer tubular; and, a ball dropping system disposed between the frac plug and the setting tool. The ball dropping system includes: a ball retention feature arranged to releasably secure the ball; an ejection arrangement blocked from activating in a first condition of the ball dropping system, activatable in a second condition of the ball dropping system, and activated to eject the ball from the ball dropping system in a third condition of the ball dropping system; and, a setting sleeve movable from a first position to a second position with respect to the ejection arrangement, the setting sleeve having the first position to block the ejection arrangement from activating in the first condition of the ball dropping system, and the setting sleeve movable to the second position to render the ejection arrangement activatable in the second condition of the ball dropping system, and the setting sleeve movable from the first position to the second position by the setting tool.

A method of dropping a ball downhole includes: running a ball dropping system in a first condition, the ball dropping system including a ball retention feature releasably securing the ball; an ejection arrangement configured to eject the ball from the ball dropping system; and a setting sleeve movable with respect to the ejection arrangement, the setting sleeve having a first position in the first condition in which the ejection arrangement is not activatable and the ball remains secured by the ball retention feature in the first condition of the ball dropping system; moving the setting sleeve from the first position to a second position corresponding to a second condition of the ball dropping system, the ejection arrangement activatable in the second condition of the ball dropping system; increasing flow rate exteriorly of the ball dropping system to activate the ejection arrangement; and, ejecting the ball in a third condition of the ball dropping system.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
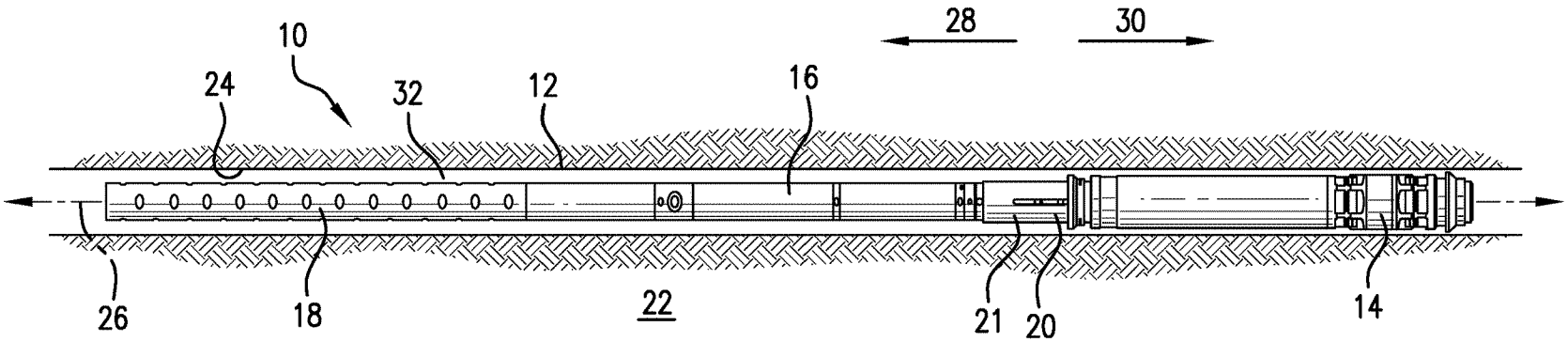
FIG. 1 depicts a schematic illustration of an embodiment of a downhole assembly.

Embodiments of a ball dropping system are employable within a downhole assembly 10. The downhole assembly 10 is usable in a "plug and perf" operation. The downhole assembly 10, as shown in FIG. 1, includes a ball dropping system 20 disposed longitudinally between a setting tool 16 and a frac plug 14. The ball dropping system 20 is incorporated into a wireline adaptor kit 21 that connects the setting tool 16 to the frac plug 14. The ball dropping system 20 carries and releasably secures a frac ball for the frac plug 14. The downhole assembly 10 further includes a perforation gun 18 located uphole of the setting tool 16. The downhole assembly 10 may be provided within a downhole structure (tubular) 12, such as a borehole that is lined, cased, or cemented. The ball dropping system 20 extends along a longitudinal axis 26, and the other components of the downhole assembly 10 may also extend along the same longitudinal axis 26. The downhole assembly 10 may be run downhole by use of a wireline system. In one embodiment, the downhole assembly 10 is a bottom hole assembly ("BHA") for a "plug and perf" operation. The downhole assembly 10 is positioned downhole and the frac plug 14 is set in the structure 12 (an outer tubular) by the setting tool 16 for isolating a production zone 22. During the setting operation, the ball dropping system 20 is adjusted from a first condition (such as a run-in condition) to a second condition (such as a pre-dropping or set condition). The frac plug 14 may be retrievable, drillable, dissolvable, and/or disintegratable, and may be formed from composites, metals, polymers, or other suitable materials. After a setting operation, the setting tool 16 and ball dropping system 20 may be uncoupled from the frac plug 14. That is, the ball dropping system 20 may be attached to the frac plug 14 during running the downhole assembly 10 and setting the frac plug 14, and then detached from the frac plug 14 subsequent the setting of the frac plug 14 and prior to an expected increase flow rate exteriorly of the downhole assembly 10. The perforation guns 18 are used to form perforations in the formation in the zone 22. Although not shown, multiple perforation guns 18 may be included in the downhole assembly 10 for forming multiple perforated sections in the zone 22 and other production zones. An increase in fluid flow in an annulus 32 between the downhole assembly 10 and the wall 24 of structure 12, such as, but not limited to, increased flow that results from the perforation operation or flow from surface pumps or flow past BHA during POOH, will result in a third condition (dropped condition) of the ball dropping system 20 that causes the frac ball restrained in the ball dropping system 20 to eject from the ball dropping system 20 and seat within the frac plug 14. The ball dropping system 20 may be detached from the frac plug 14 prior to firing the perforation guns 18. Thus, the frac ball will not drop until the perforation operation occurs or other threshold fluid flow rate is reached. Thus, flow through the frac plug 14 is maintained if the perforation gun 18 fails to fire.

One embodiment of the ball dropping system 20 is shown in FIGS. 2-5. The frac ball 40 is held within a ball retention feature 42 of the ball dropping system 20 in both the first condition (run-in) and second condition (set condition), and released/ejected by an ejection arrangement 44 in the third condition (dropped condition). For the purposes of description herein, "ball" 40 may be used to describe a substantially spherical object, such as depicted in the figures, however the ball 40 may also refer to a dart, a plug or other device that can pass from the ball dropping system 20 to a seat 46 (FIG. 13) within the frac plug 14. The ball 40 is selected, as by sizing and material selection, to be stopped by and sealed against the seat 46 of the frac plug 14. The ball retention feature 42 secures the ball 40 within the ball dropping system 20 until the ball 40 is intended to be released. In the embodiment of FIGS. 2-5, the ball retention feature 42 includes a first set of leaf springs 48 having a first end 50 (uphole end) and a second end 52 (downhole end). A grasping portion 54 of the first set of leaf springs 48 between the first and second ends 50, 52 is sized to partially surround the frac ball 40 and block downhole movement past the second ends 52 of the first set of leaf springs 48 in the first and second conditions of the ball dropping system 20. The first set of leaf springs 48 may be secured to a tension mandrel 56 using tabs (not shown) that protrude radially inwardly from the first set of leaf springs 48 and into a corresponding groove 58 in the tension mandrel 56. The tension mandrel 56 extends into a tension sleeve 60, and the grasping portion 54 and the second ends 52 are radially flexible within the tension sleeve 60. The tension sleeve 60 includes a plurality of radial slots 62 that are longitudinally aligned with the grasping portion 54 of the first set of leaf springs 48.

Figure 2:
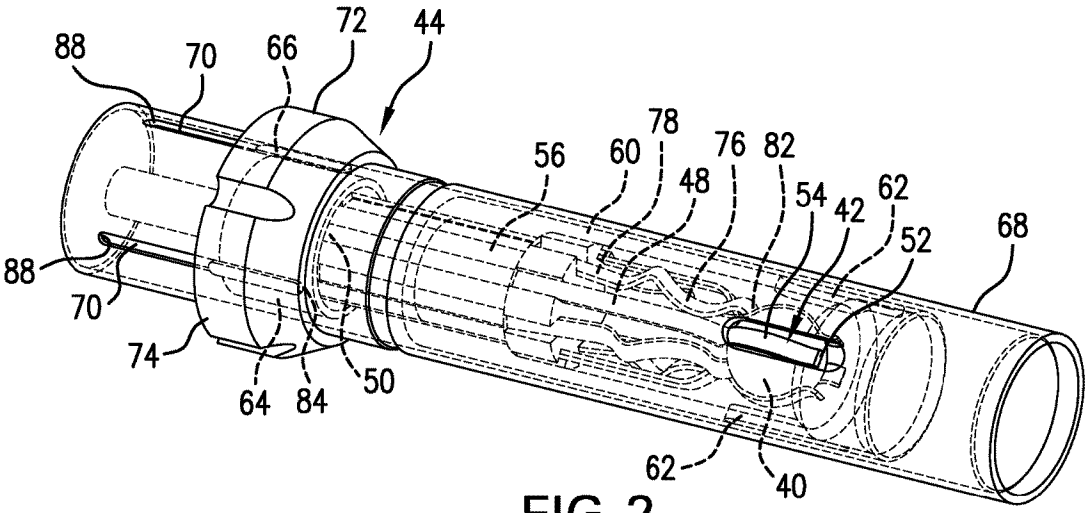
FIG. 2 depicts a perspective view of an embodiment of a ball dropping system for the downhole assembly of FIG. 1, with some portions shown in phantom.
Figure 3:
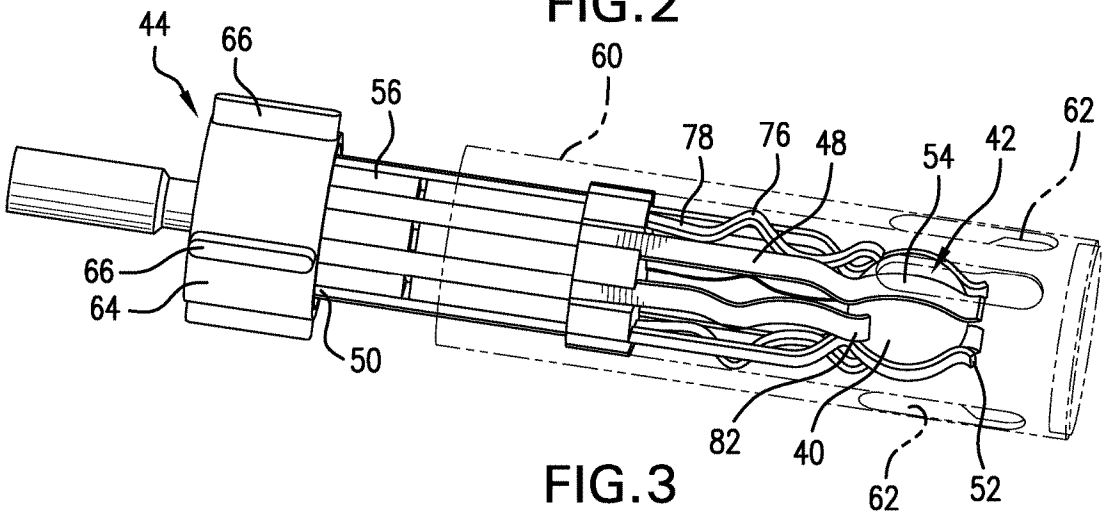
FIG. 3 depicts a perspective of portions of the ball dropping system of FIG. 2, with some portions shown in phantom.
Figure 4A:
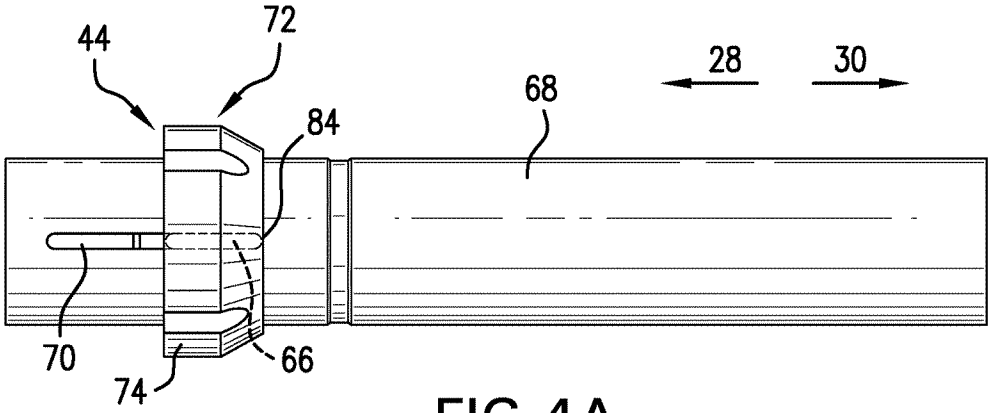
FIGS. 4A and 4B depict a side view of the ball dropping system of FIG. 2 in first and second conditions, respectively.
Figure 4B:
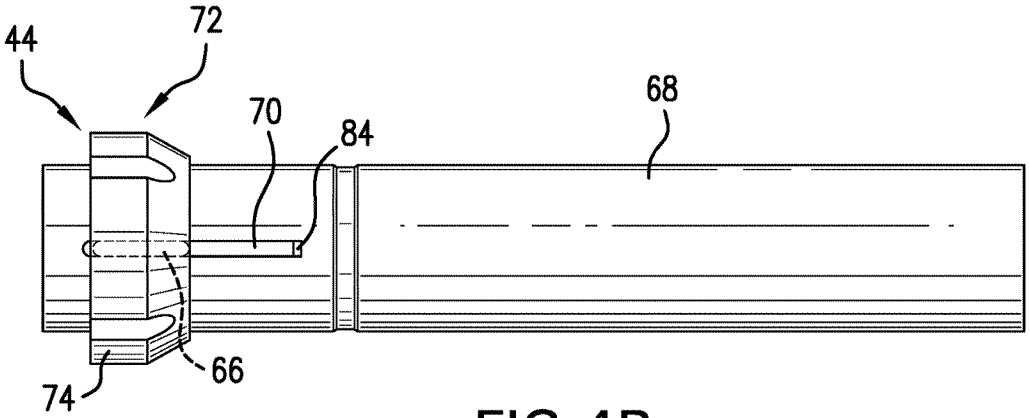

The ball dropping system 20 further includes the ejection arrangement 44 configured to eject the ball 40 from the ball dropping system 20 that is releasably secured by the ball retention feature 42. In the illustrated embodiment, the ejection arrangement 44 includes a key ring 64 having one or more keys 66 radially protruding from an exterior surface of the key ring 64. As shown in FIGS. 2, 4A and 4B, a setting sleeve 68 includes one or more keyways 70. The setting sleeve 68 surrounds the key ring 64, tension mandrel 56, and tension sleeve 60. The keys 66 extend respectively through the keyways 70. The ejection arrangement 44 further includes a flow-interaction protrusion 72, such as, but not limited to a flow catcher/wiper ring 74, which at least partially surrounds the setting sleeve 68 and is connected to the key ring 64. The ejection arrangement 44 may further include an ejector, such as pusher 76 attached to the key ring 64, such that an increase in flow will move the flow-interaction protrusion 72, which will move the attached key ring 64 and pusher 76. Under such a condition, the pusher 76 will engage with the ball 40 and push the ball out of the ball retention feature 42. In the illustrated embodiment, the pusher 76 includes a second set of leaf springs 78, where the tab 58 protruding radially outwardly between first (uphole) ends 80 and second (downhole) ends 82 are engaged and pushable by the key ring 64, and the second (downhole) ends 82 of the second set of leaf springs 78 are engageable with the ball 40. Also, as can be seen in the figures, the first and second set of leaf springs 48, 78 may be the same part but held in opposite directions to reduce the number of parts required to manufacture the ball dropping system 20. That is, the same leaf springs are positioned in a reverse configuration, and using the same part to perform two separate functions increases simplicity in manufacturing the system 20. In alternate embodiments, the pusher 76 may take on other forms, such as a piston rod, ramming device, or other shape that can engage with the ball and force it from the ball retention feature 42. Also, while a pusher 76 is described, the ejector may alternatively include a "puller" or other device that is positioned downhole of the frac ball 40 and adjusts a portion in the ejection arrangement 44 that causes the ball retention feature 42 to release the ball 40.

Figure 5:
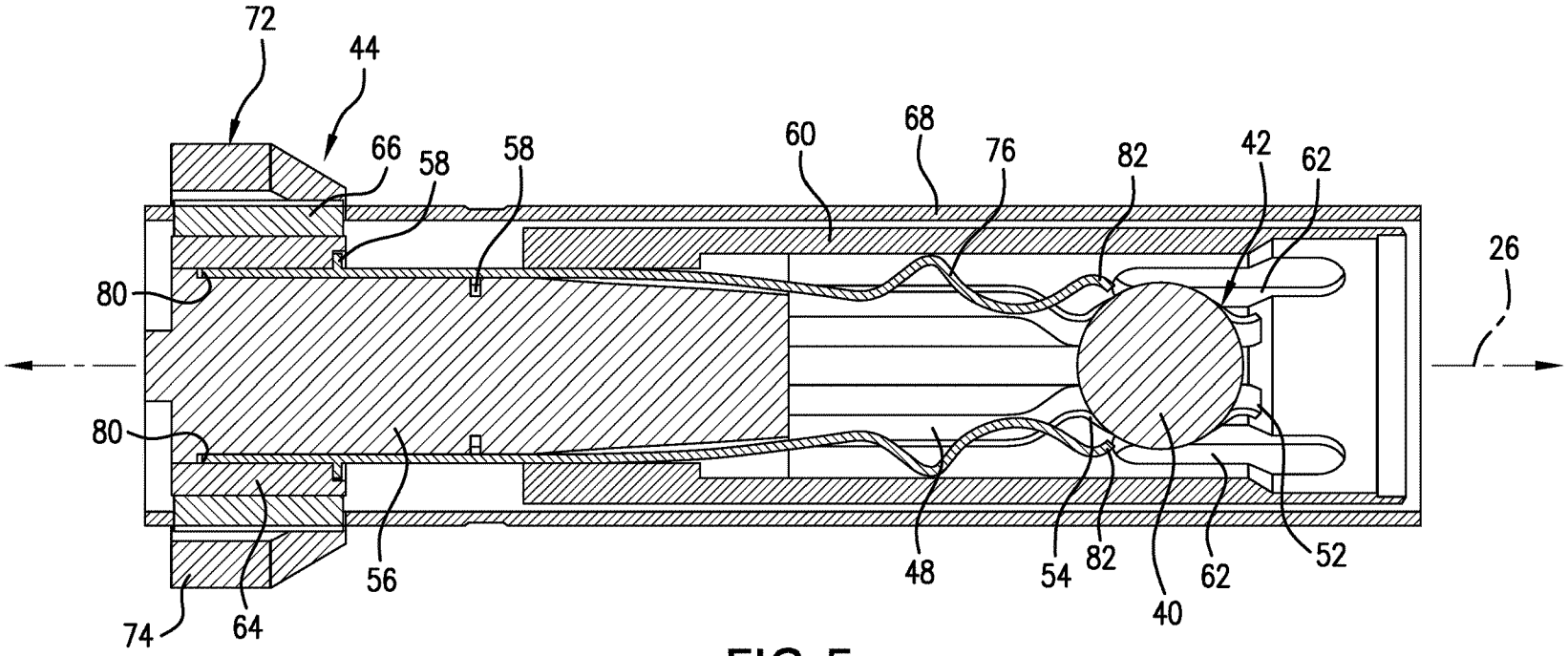
FIG. 5 depicts a sectional view of the ball dropping system of FIG. 2.
Figure 6:
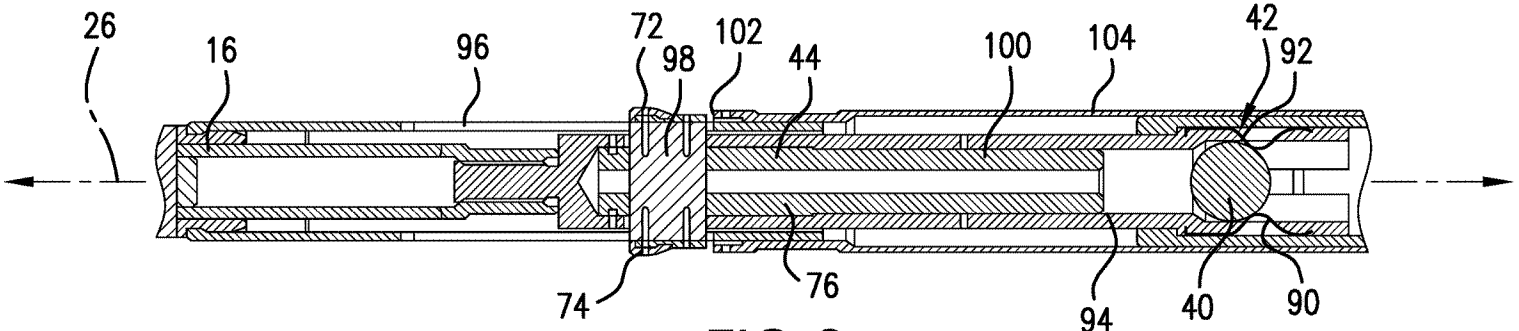
FIG. 6 depicts a sectional view of another embodiment of a ball dropping system for the downhole assembly of FIG. 1.
Figure 7A:
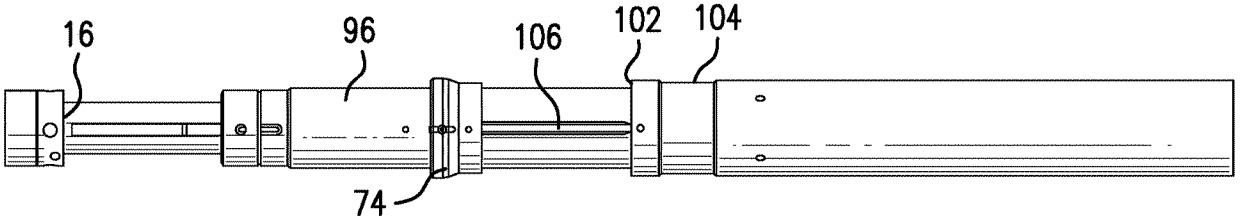
FIGS. 7A and 7B respectively depict a side view and a sectional view of the ball dropping system of FIG. 6 in a second condition.
Figure 7B:
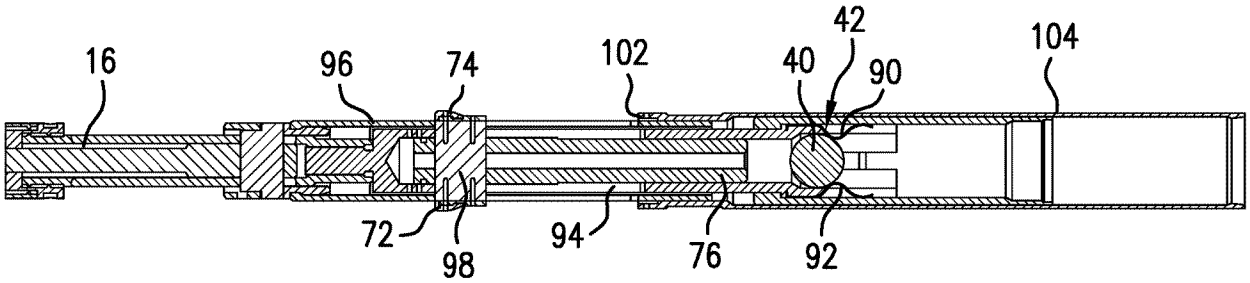
Figure 8:
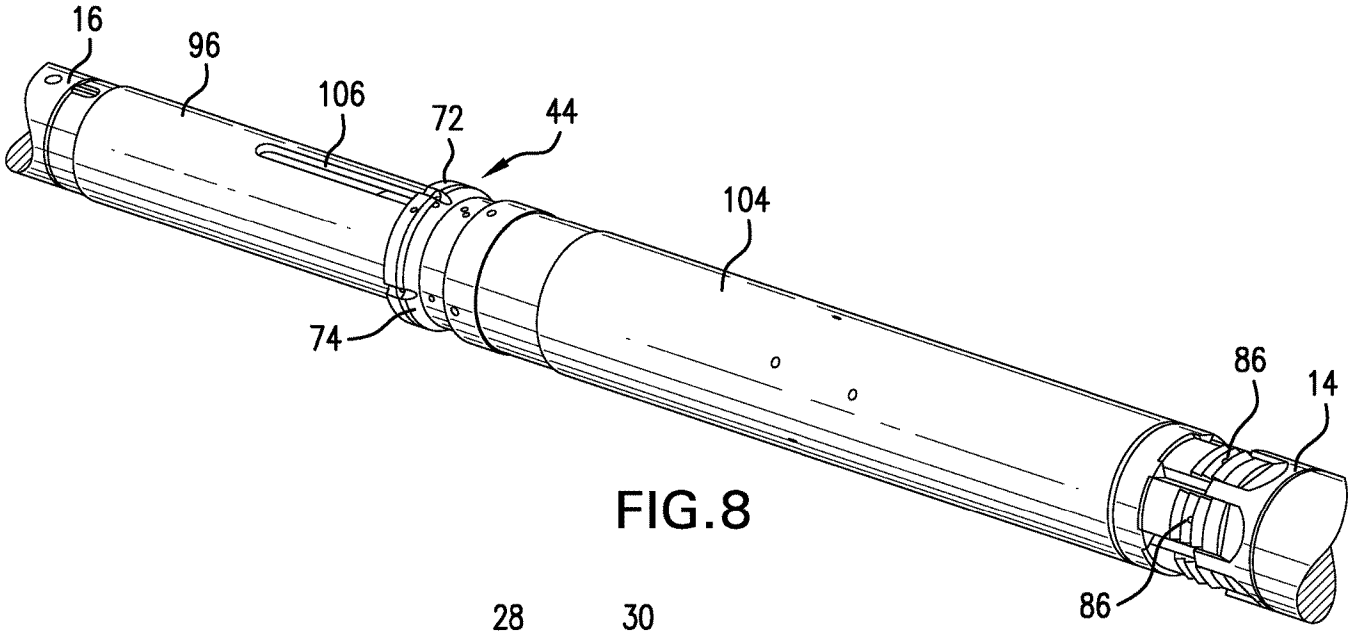
FIG. 8 depicts a perspective view of the ball dropping system of FIG. 6.
Figure 9:
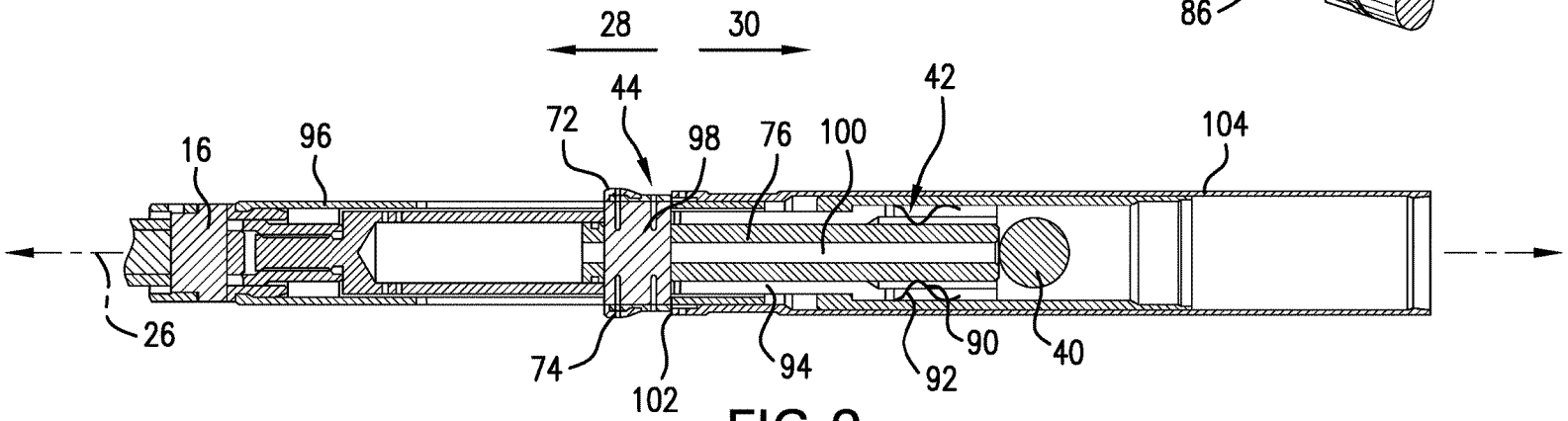
FIG. 9 depicts a sectional view of the ball dropping system of FIG. 6 in a third condition.
Figure 14:
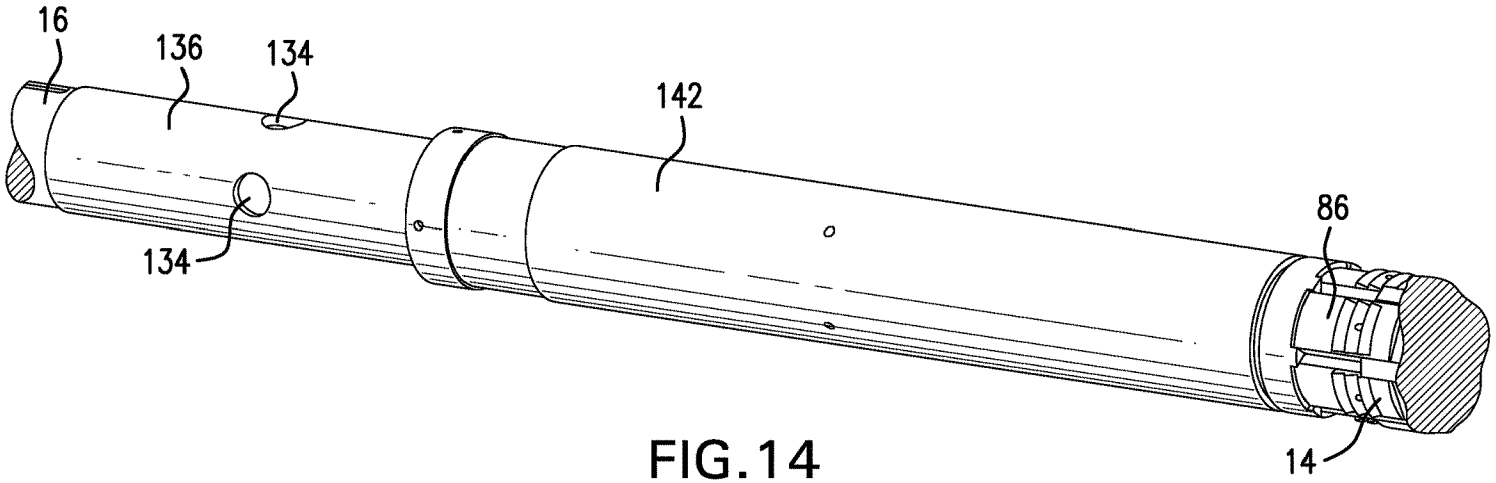
FIG. 14 depicts a perspective view of the ball dropping system of FIG. 13 in a first condition; and, FIGS. 15A and 15B depict a sectional view of the ball dropping system of FIG. 13 in second and third conditions, respectively.
Figure 15A:
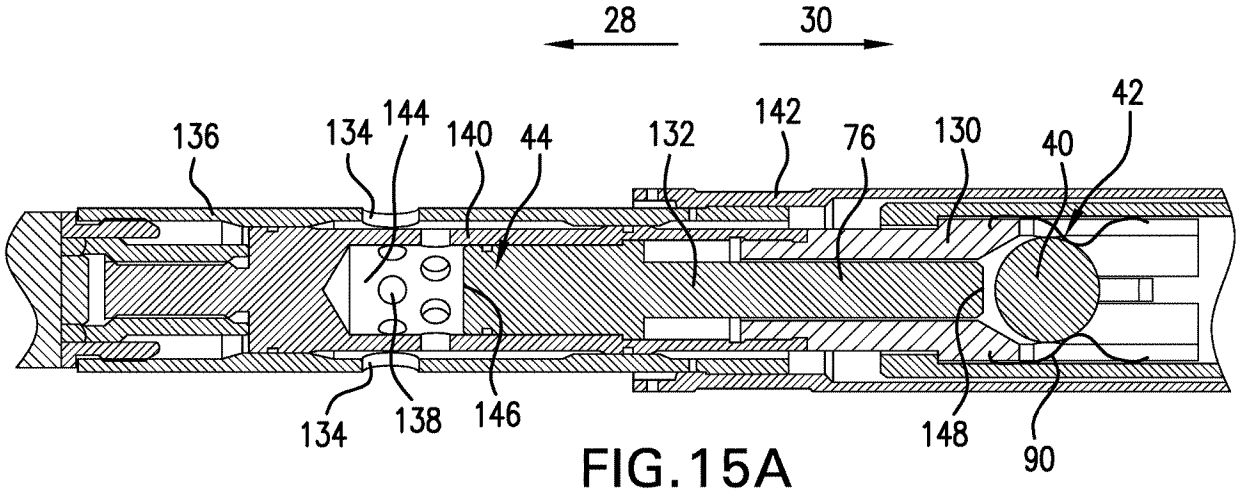
Figure 15B:
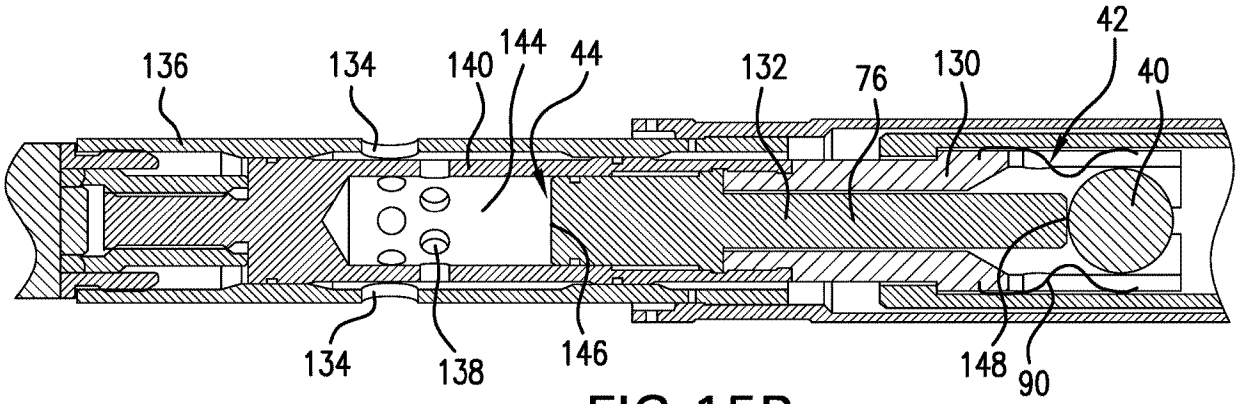

In the first condition, the setting sleeve 68 and the wiper ring 74 have a first position, as shown in FIGS. 2, 4A, and 5 where the keys 66 are located at a downhole end 84 of the keyways 70. Thus, the keys 66 and attached key ring 64 and pusher 76 are unable to translate in the downhole direction 30 in the first condition. In the second condition, the setting sleeve 68 is translated in the downhole direction 30 by the setting tool 16. The setting sleeve 68 moves relative to the key ring 64 and keys 66 and pusher 76 such that once the frac plug 14 is set within the structure 12 by the setting tool 16 (such as when slips 86 (FIGS. 8, 14) of the frac plug 14 are radially outwardly engaged with the wall 24 of the structure 12), the keys 66 are positioned at the uphole ends 88 of the keyways 70. Then, when a flow having at least a threshold flow rate within the annulus 32 is reached, such as when the perforating guns 18 are fired, flow increases from surface pumps, or flow past BHA during POOH, the flow-interaction protrusion 72 will be forced in the downhole direction 30, which will carry the key ring 64 and pusher 76 all in the downhole direction 30 while the keys 66 travel in the keyways 70 of the setting sleeve 68. The second ends 82 of the second set of leaf springs 78 will force the ball 40 in the downhole direction 30, which forces the grasping portions 54 to move radially outwardly into slots 62 of the tension sleeve 60, such that the ball 40 will be able to bypass the second ends 52 of the first set of leaf springs 48. Thus, the ball 40 is ejected from the ball dropping system 20 and will then seat in the frac plug 14.

FIGS. 6-9 show another embodiment of the ball dropping system 20. The ball retention feature 42 includes a set of leaf springs 90 having an inwardly radially protruding portion 92, such that the frac ball 40 is situated within a tension mandrel 94 and in the uphole direction 28 from the radially protruding portion 92, and thus releasably secured within the ball dropping system 20 by the ball retention feature 42. The ejection arrangement 44 includes a flow-interaction protrusion 72, such as the wiper ring 74, pump down ring or other flow catcher, which is positioned around an elongated adjusting nut 96. The ejection arrangement 44 further includes a connection, such as a cross-link 98, which connects the wiper ring 74 to an uphole portion of a pusher 76, which in this embodiment is a piston mandrel 100. The wiper ring 74, cross-link 98, and piston mandrel 100 of the ejection arrangement 44 are blocked from moving longitudinally in the first condition by a stop, such as by a shoulder 102 of the setting sleeve 104. There is a slot 106 (best seen in FIGS. 7A and 8) in the adjusting nut 96 that the cross-link 98 can pass through. During assembly, once the piston mandrel 100, tension mandrel 94, and adjusting nut 96 are assembled together, then the cross-link 98 is inserted therethrough, and then the wiper ring 74 is brought up and set screwed in place. Intermediately, in the second condition shown in FIGS. 7A and 7B, the adjusting nut 96 and the setting sleeve 104 have been stroked down relative to the tension mandrel 94, flow-interaction protrusion 72, and cross-link 98, which pushes the slot 106 downhole. The second condition then subsequently allows the ejection arrangement 44 to translate further down upon activation to the third condition. That is, the ejection arrangement 44 is blocked from moving further down before the frac plug 14 is set, and then the setting operation will push the uphole end of the slot 106 towards the cross-link 98, so that the cross-link 98 can then translate towards the downhole end of the slot 106 within the slot 106. In the second condition shown in FIGS. 7A and 7B, the spring force of the set of leaf springs 90 (FIG. 6) holds the ball 40 in place, and the ejection arrangement 44 will not translate downwardly without a significant flow rate such as a threshold flow rate in the annulus 32 to occur. Nonetheless, in one embodiment (not illustrated), a shear screw or shear wire may be used to prevent the inadvertent transition of the ball dropping system 20 from the second condition to the third condition.

Thus, in the first condition, the piston mandrel 100 is not longitudinally movable relative to the tension mandrel 94 and the ball 40 is retained within the tension mandrel 94 by the first set of leaf springs 90 of the ball retention feature 42. In the second condition, the setting tool 16 strokes the adjusting nut 96 and the attached setting sleeve 104 in the downhole direction 30. The adjusting nut 96 and setting sleeve 104 move relative to the tension mandrel 94 and piston mandrel 100 and frac ball 40. Thus, in the second condition the cross-link 98 is spaced from the stop 102 and ready for movement to the third condition. When the threshold flow rate within the annulus 32 is reached or exceeded, the wiper ring 74 is moved in the downhole direction 30 with the cross-link 98, moving the piston mandrel 100 in the downhole direction 30 towards the frac ball 40. The downhole end of the piston mandrel 100 pushes the frac ball 40 past the ball retention feature 42 by forcibly radially expanding the leaf springs 90 radially outwardly through the force of the frac ball 40 moving in the downhole direction 30, and the ball 40 is pushed out of the downhole ball dropping system 20 (FIG. 9) for dropping into and seating within the frac plug 14.

Figure 10A:
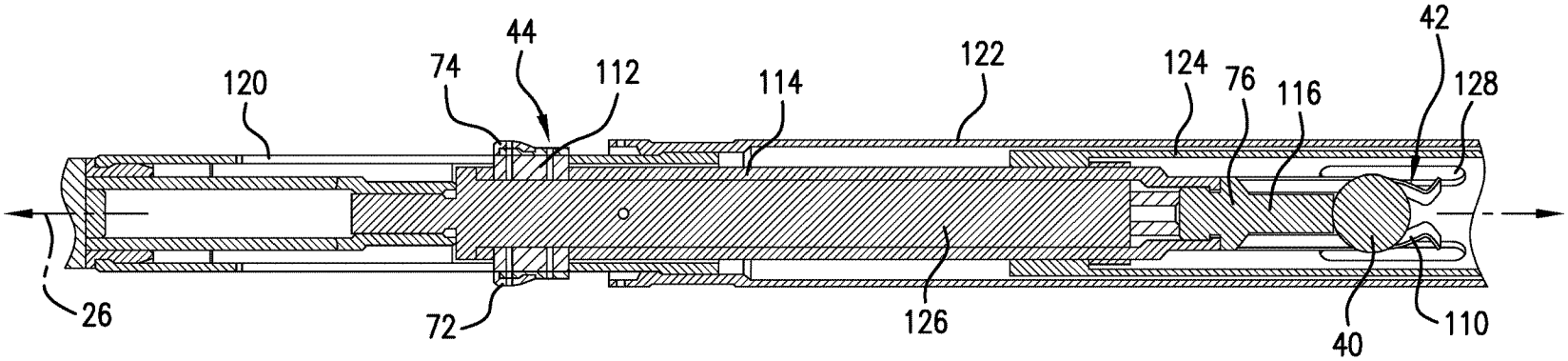
FIGS. 10A and 10B depict a sectional view and a side view, respectively, of another embodiment of a ball dropping system for the downhole assembly of FIG. 1 in a first condition.
Figure 10B:
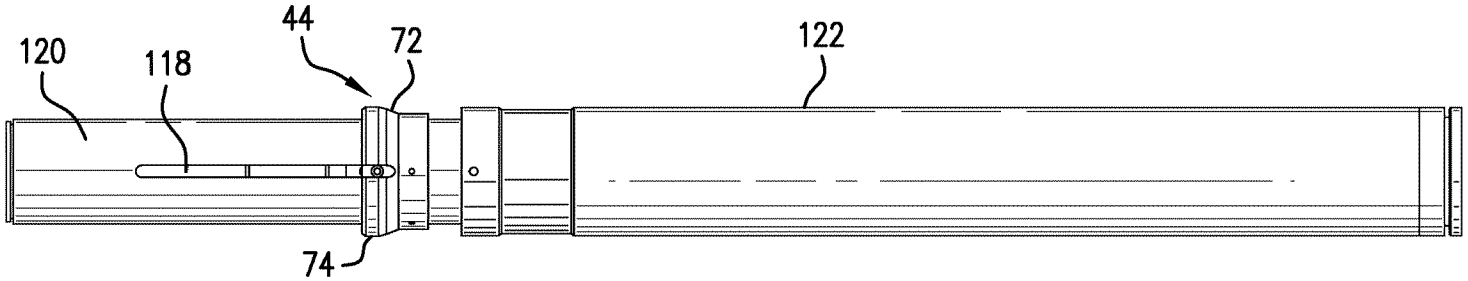
Figure 11A:
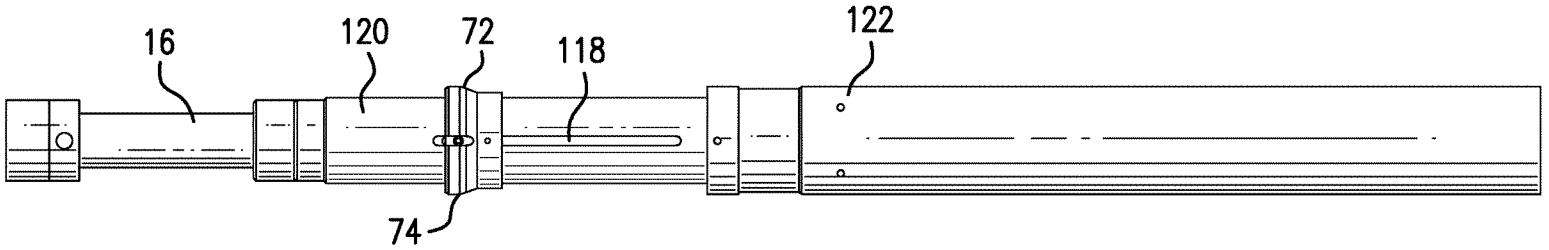
FIGS. 11A and 11B depict a side view and a sectional view, respectively, of the ball dropping system of FIGS. 10A and 10B, in a second condition.
Figure 11B:
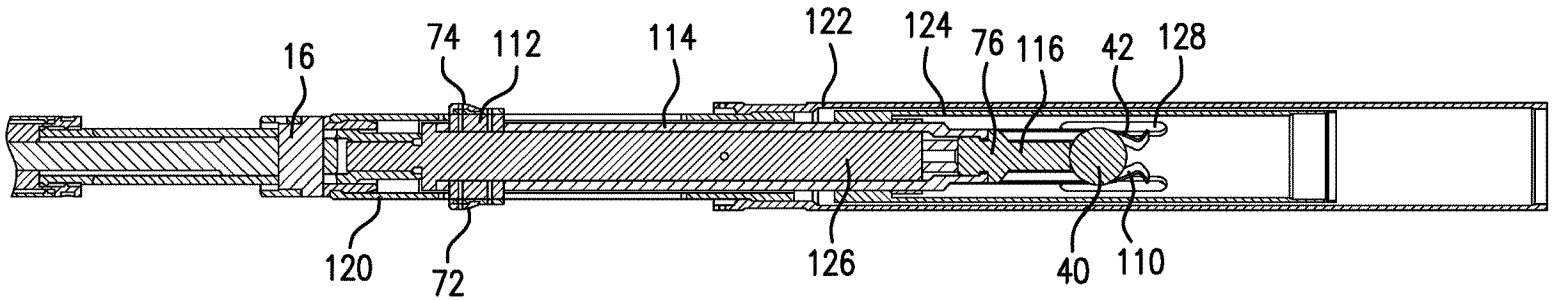
Figure 12:
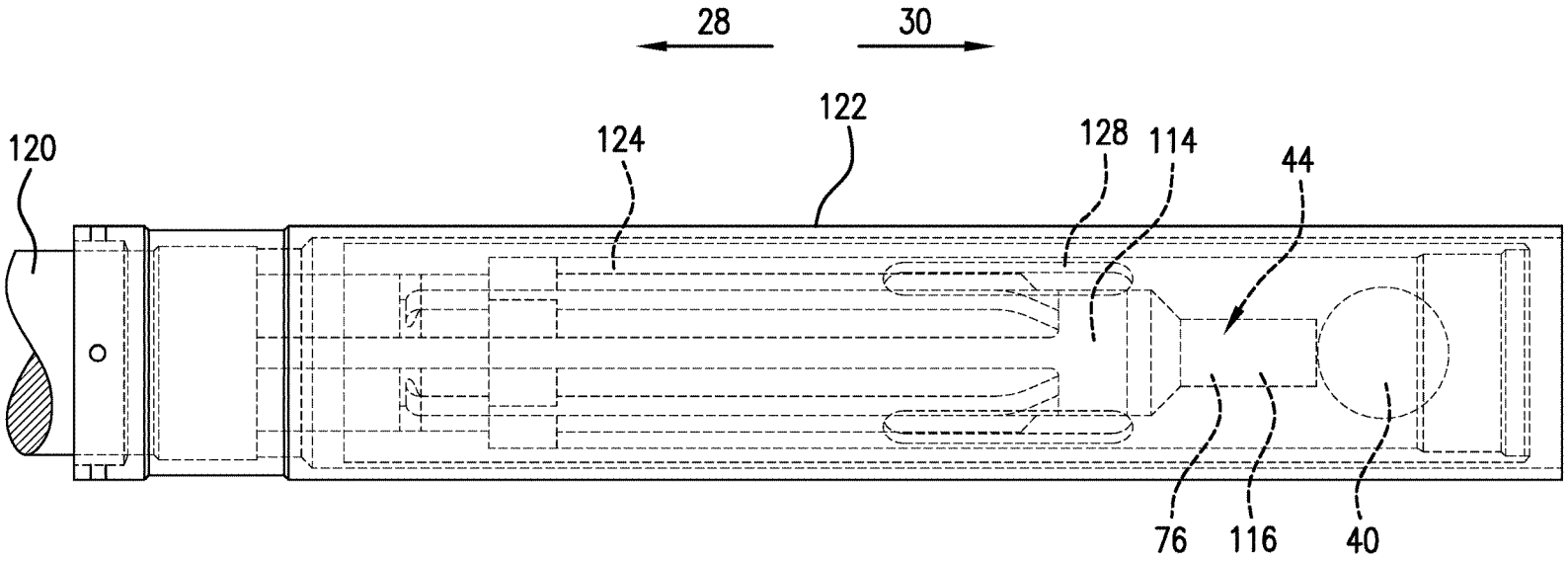
FIG. 12 depicts a side view of the ball dropping system of FIGS. 10-11 in a third condition, with some portions shown in phantom.

Turning now to FIGS. 10-12, another embodiment of the ball dropping system 20 is shown. The ball retention feature 42 includes a set of leaf springs 110 to restrain the frac ball 40 within the ball dropping system 20. The ejection arrangement 44 includes a flow-interaction protrusion 72 attached to keys 112, which in turn are connected to a slotted mandrel 114 which is attached to a pusher 76, in this embodiment a piston mandrel 116. In the first position (FIGS. 10A and 10B), the keys 112 are at an end of keyways 118 within an adjusting nut 120, and thus the piston mandrel 116 cannot eject the ball 40 from the ball retention feature 42. When the setting tool 16 strokes, the adjusting nut 120 and setting sleeve 122 stroke in the downhole direction 30, moving the keyway 118 relative to the keys 112 (see FIGS. 11A and 11B). That is, after the setting tool 16 sets the frac plug 14, the ejection arrangement 44 is activatable due to at least a portion of the keyway 118 now being positioned downhole relative to the keys 112. Thus, in the third condition (FIG. 12), with the application of flow on the wiper ring 74, the keys 112 and the slotted mandrel 114 are able to stroke downhole pushing the frac ball 40 out of the ball dropping system 20 with the piston mandrel 116. The leaf springs 110 may be fixed in place by the tension sleeve 124 and tension mandrel 126, and the tension sleeve 124 has slots 128 that allows the leaf springs 110 to flare out when the frac ball 40 is pushed out by the piston mandrel 116.

Figure 13:
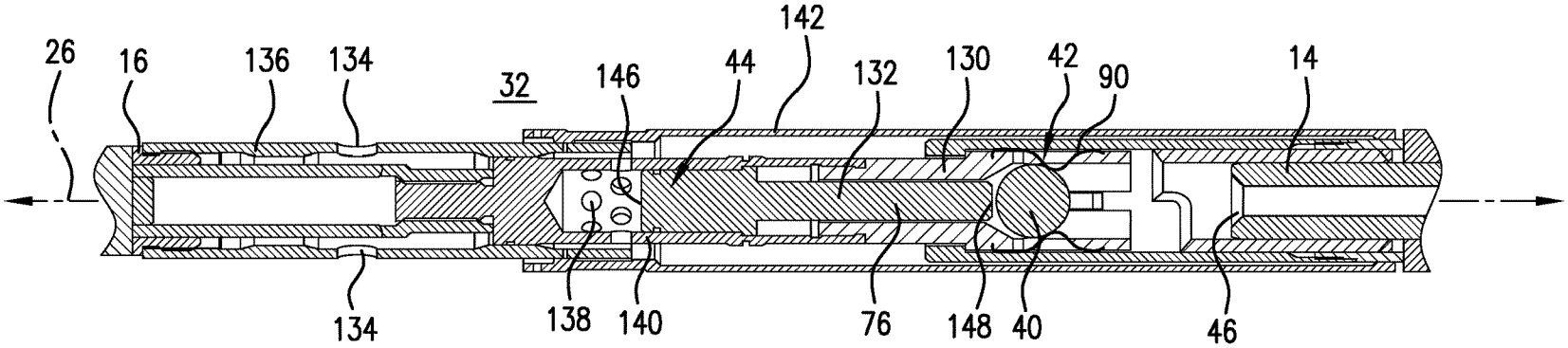
FIG. 13 depicts a sectional view of another embodiment of a ball dropping system for the downhole assembly of FIG. 1.

Turning now to FIGS. 13-15B, another embodiment of the ball dropping system 20 is shown. The ball retention feature 42 includes a set of leaf springs 90. The frac hall 40 is held within the tension mandrel 130 until forced out by the ejection arrangement 44 that includes a piston mandrel 132 as the pusher 76. Activation of the ejection arrangement 44 is blocked prior to the frac plug 14 being set, and activation of the ejection arrangement 44 is permitted after the setting tool 16 sets the frac plug 14. In the first condition of the ball dropping system 20, as shown in FIG. 13, apertures 138 within an apertured mandrel 140 that supports the piston mandrel 132 therein are fluidically blocked from the annulus 32. When the setting tool 16 sets the frac plug 14, the adjusting nut 136 and the connected setting sleeve 142 (which may be threaded together) move in the downhole direction 30, relative to the apertured mandrel 140, piston mandrel 132, and ball retention feature 42. Thus, in the second condition (FIG. 15A), one or more radial ports 134 in the adjusting nut 136 are fluidically communicated with the apertures 138 in the apertured mandrel 140. An increase in fluid pressure due to pressure drop from a threshold flow rate in the annulus 32 that exceeds a threshold pressure will communicate to an interior 144 of the apertured mandrel 140 through the flow path formed by the ports 134 and apertures 138, and the fluid pressure will act on an uphole end 146 of the piston mandrel 132 to move the piston mandrel 132 in the downhole direction 30 by the fluid pressure. The downhole end 148 of the piston mandrel 132 will engage with the frac ball 40 and force it past the leaf springs 90 of the ball retention feature 42. The frac ball 40 will then be ejected from the ball dropping system 20 (FIG. 15B) and move towards the frac plug 14, such as for seating on the seat 46.

Incorporating the ball dropping system 20 into the WLAK 21 (which makes up the plug 14 to the setting tool 16) enables the use of industry standard setting tools, and adapts to a variety of different types of frac plugs. Also, since a setting operation already occurs through use of the setting tool 16, the operation to move the ball dropping system 20 from the first condition to the second condition requires no extra steps by an operator, but does prevent premature ejection of the ball 40. If the ball 40 was already on seat within the frac plug 14, and the perforation guns 18 fail to fire, then it would not be possible to pump anything else down, as pumping anything down with wireline requires pumping fluid into the open perforations to get movement. But if there are no perforations, then this is not possible. The embodiments of the ball dropping system 20 thus prevent loss of time by eliminating the need to launch a ball 40 from surface, since these embodiments employ a ball 40 at depth, and these embodiments further eliminate problems that would arise if the perforation guns 18 fail to fire.

The embodiments of the ball dropping system 20 are flow activated. The ball dropping system 20 is exposed to the fluid and fluid flow rate exterior of the ball dropping system 20. In the first and second conditions of the ball dropping system 20, the fluid flow rate is below a threshold flow rate and the ball dropping system is not activated. When the fluid flow rate reaches the threshold flow rate (or exceeds the threshold flow rate), the ball dropping system is activated to the third condition. Embodiments of the ball dropping system 20 may be varied as to what is acting on the ball 40, whether it is leaf springs, piston mandrel, or other pusher or the flow itself. While leaf springs have been described as part of the ball retention feature 42 for holding the ball 40 within the ball dropping system 20, the ball retention feature may alternatively include ball bearings, collet, shear screws, c-ring or some other retention mechanism. After pulling uphole and firing the perforation guns 18, an increase in flow around and/or through the setting tool 16 will act on an ejection arrangement 44, which will in turn eject the ball 40 when the increase in flow in the annulus 32 is sufficient to thrust the ball 40 out of its retention feature 42. Also, as opposed to having the piston mandrel or other pusher 76, flow may be directable during the second condition to act directly on the ball 40 itself, and used to force the ball 40 out of the ball retention feature 42. Thus, the ball 40 is dropped and able to land on the set frac plug 14 in the wellbore below. The ball 40 may be a spherical object, a dart, or a series or combination of either. The piston mandrel in the above-described embodiments could be a pressure chamber or atmospheric chamber. The increased flow could be a result of an increase POOH speed or increasing pump rate. The flow-interaction protrusion 72 may be a wiper ring such as a rubber ring, a rubber wiper fin that contacts the casing, or a component of different material that creates a pressure drop to promote either flow through an alternate flow path or a pressure differential that causes the ring component and ejection arrangement 44 to shift downhole. Alternatively, a port profile may be configured to promote enough flow through the WLAK 21 without the need for a flow diversion device.

Thus, an operator is able to convey a ball 40 downhole and then control when it is deployed, allowing an operator to set a frac plug 14, fire perforating guns 18, and only then initiate the procedure to drop the ball 40. The ball dropping system 20 is activated after the setting tool 16 is fired, and only after a threshold flow rate is established, in order to force the ball 40 out. This solves the problem of having to drop a ball from surface and pump it down to depth to seat on a tool, thus wasting excessive water in the process. Also, these embodiments avoid some of the problems that occur if a frac ball is on seat of a frac plug if the perforation guns 18 fail to fire, avoiding waste of resources and time.

Set forth below are some embodiments of the foregoing disclosure:

Embodiment 1: A ball dropping system includes a ball retention feature; an ejection arrangement blocked from activating in a first condition of the ball dropping system, activatable in a second condition of the ball dropping system, and activated to eject a ball from the ball dropping system that is releasably secured by the ball retention feature in a third condition of the ball dropping system; and, a setting sleeve movable from a first position to a second position with respect to the ejection arrangement, the setting sleeve having the first position to block the ejection arrangement from activating in the first condition of the ball dropping system, and the setting sleeve movable to the second position to render the ejection arrangement activatable in the second condition of the ball dropping system.

Embodiment 2: The ball dropping system of any of the preceding embodiments, wherein in the third condition of the ball dropping system, the ejection arrangement is activated by a fluid flow rate, substantially equal to or greater than a threshold flow rate, exteriorly of the ball dropping system.

Embodiment 3: The ball dropping system of any of the preceding embodiments, wherein the ejection arrangement includes an outwardly protruding flow interaction protrusion configured to engage with fluid flow exteriorly of the ball dropping system to activate the ejection arrangement.

Embodiment 4: The ball dropping system of any of the preceding embodiments, wherein the protrusion is mechanically connected to a pusher, and longitudinal movement of the protrusion by the fluid flow correspondingly moves the pusher to eject the ball from the ball retention feature.

Embodiment 5: The ball dropping system of any of the preceding embodiments, wherein the ball retention feature includes an expandable ball grasping portion that is radially expanded in the third condition of the ball dropping system.

Embodiment 6: The ball dropping system of any of the preceding embodiments, wherein the ejection arrangement includes a radially apertured mandrel, and movement of the setting sleeve to the second position fluidically communicates a port of an adjusting nut with an aperture of the apertured mandrel to permit fluid flow exterior of the ball dropping system to access an interior of the apertured mandrel.

Embodiment 7: The ball dropping system of any of the preceding embodiments, further comprising a piston mandrel disposed downhole of the aperture, the piston mandrel configured to move in a downhole direction towards the ball retention feature upon receipt of the fluid flow in the interior of the apertured mandrel.

Embodiment 8: The ball dropping system of any of the preceding embodiments, wherein the ball retention feature includes a set of leaf springs.

Embodiment 9: The ball dropping system of any of the preceding embodiments, wherein a ball grasping portion of the leaf springs are movable to a radially expanded position in the third condition of the ball dropping system.

Embodiment 10: The ball dropping system of any of the preceding embodiments, wherein the ejection arrangement includes a piston mandrel that is configured to push the ball through the ball retention feature in the third condition of the ball dropping system.

Embodiment 11: The ball dropping system of any of the preceding embodiments, further comprising an adjusting nut having a port and movable with the setting sleeve, and an apertured mandrel having an aperture, wherein the aperture is fluidically blocked from fluid pressure exterior to the ball dropping system in the first condition, and the port is in fluidic communication with the aperture in the second condition to permit fluidic communication between an interior of the apertured mandrel and fluid flow exterior to the ball dropping system Embodiment 12: The ball dropping system of any of the preceding embodiments, wherein the fluid flow received in the interior of the apertured mandrel in the third condition ejects the ball from the ball retention feature.

Embodiment 13: The ball dropping system of any of the preceding embodiments, further comprising a piston mandrel movable by the fluid flow passed through the port and aperture in the third condition, wherein the piston mandrel forces the ball out of the ball retention feature.

Embodiment 14: The ball dropping system of any of the preceding embodiments, wherein ball dropping system is configured to be disposed between a frac plug and a setting tool, the setting sleeve movable from the first position to the second position by the setting tool to set the frac plug.

Embodiment 15: A downhole assembly includes a frac plug configured to receive a ball; a setting tool configured to set the frac plug within an outer tubular; and, a ball dropping system disposed between the frac plug and the setting tool. The ball dropping system includes: a ball retention feature arranged to releasably secure the ball; an ejection arrangement blocked from activating in a first condition of the ball dropping system, activatable in a second condition of the ball dropping system, and activated to eject the ball from the ball dropping system in a third condition of the ball dropping system; and, a setting sleeve movable from a first position to a second position with respect to the ejection arrangement, the setting sleeve having the first position to block the ejection arrangement from activating in the first condition of the ball dropping system, and the setting sleeve movable to the second position to render the ejection arrangement activatable in the second condition of the ball dropping system, and the setting sleeve movable from the first position to the second position by the setting tool.

Embodiment 16: The downhole assembly of any of the preceding embodiments, further comprising a perforation gun, wherein, upon firing the perforation gun, the ejection arrangement is activated by a fluid flow rate, substantially equal to or greater than a threshold flow rate, exteriorly of the ball dropping system in the third condition of the ball dropping system.

Embodiment 17: The downhole assembly of any of the preceding embodiments, wherein the ejection arrangement includes a first portion configured to engage with fluid flow exterior to the ball dropping system and an ejector configured to eject the ball from the ball retention feature.

Embodiment 18: A method of dropping a ball downhole includes: running a ball dropping system in a first condition, the ball dropping system including a ball retention feature releasably securing the ball; an ejection arrangement configured to eject the ball from the ball dropping system; and a setting sleeve movable with respect to the ejection arrangement, the setting sleeve having a first position in the first condition in which the ejection arrangement is not activatable and the ball remains secured by the ball retention feature in the first condition of the ball dropping system; moving the setting sleeve from the first position to a second position corresponding to a second condition of the ball dropping system, the ejection arrangement activatable in the second condition of the ball dropping system; increasing flow rate exteriorly of the ball dropping system to activate the ejection arrangement; and, ejecting the ball in a third condition of the ball dropping system.

Embodiment 19: The method of any of the preceding embodiments, wherein the ball dropping system is disposed between a setting tool and a frac plug, and further comprising actuating the setting tool to move the setting sleeve, and moving the setting sleeve additionally sets the frac plug within an outer tubular.

Embodiment 20: The method of any of the preceding embodiments, further comprising firing a perforating gun to increase the flow rate and activate the ejection arrangement.

Embodiment 21: The method of any of the preceding embodiments, further comprising uncoupling the ball dropping system from the frac plug prior to firing the perforating gun.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A ball dropping system, comprising:

a ball retention feature;

an ejection arrangement blocked from activating in a first condition of the ball dropping system, activatable in a second condition of the ball dropping system, and activated to eject a ball from the ball dropping system that is releasably secured by the ball retention feature in a third condition of the ball dropping system; and, a setting sleeve movable from a first position to a second position with respect to the ejection arrangement, the setting sleeve having the first position to block the ejection arrangement from activating in the first condition of the ball dropping system, and the setting sleeve movable to the second position to render the ejection arrangement activatable in the second condition of the ball dropping system.

2. The ball dropping system of claim 1, wherein, in the third condition of the ball dropping system, the ejection arrangement is activated by a fluid flow rate greater than a threshold flow rate, exteriorly of the ball dropping system.

3. The ball dropping system of claim 2, wherein the ejection arrangement includes an outwardly protruding flow interaction protrusion configured to engage with fluid flow exteriorly of the ball dropping system to activate the ejection arrangement.

4. The ball dropping system of claim 3, wherein the protrusion is mechanically connected to a pusher, and longitudinal movement of the protrusion by the fluid flow correspondingly moves the pusher to eject the ball from the ball retention feature.

5. The ball dropping system of claim 4, wherein the ball retention feature includes an expandable ball grasping portion that is radially expanded in the third condition of the ball dropping system.

6. The ball dropping system of claim 2, wherein the ejection arrangement includes a radially apertured mandrel, and movement of the setting sleeve to the second position fluidically communicates a port of an adjusting nut with an aperture of the apertured mandrel to permit fluid flow exterior of the ball dropping system to access an interior of the apertured mandrel.

7. The ball dropping system of claim 6, further comprising a piston mandrel disposed downhole of the aperture, the piston mandrel configured to move in a downhole direction towards the ball retention feature upon receipt of the fluid flow in the interior of the apertured mandrel.

8. The ball dropping system of claim 1, wherein the ball retention feature includes a set of leaf springs.

9. The ball dropping system of claim 8, wherein a ball grasping portion of the leaf springs are movable to a radially expanded position in the third condition of the ball dropping system.

10. The ball dropping system of claim 1, wherein the ejection arrangement includes a piston mandrel that is configured to push the ball through the ball retention feature in the third condition of the ball dropping system.

11. The ball dropping system of claim 1, further comprising an adjusting nut having a port and movable with the setting sleeve, and an apertured mandrel having an aperture, wherein the aperture is fluidically blocked from fluid pressure exterior to the ball dropping system in the first condition, and the port is in fluidic communication with the aperture in the second condition to permit fluidic communication between an interior of the apertured mandrel and fluid flow exterior to the ball dropping system.

12. The ball dropping system of claim 11, wherein the fluid flow received in the interior of the apertured mandrel in the third condition ejects the ball from the ball retention feature.

13. The ball dropping system of claim 11, further comprising a piston mandrel movable by the fluid flow passed through the port and aperture in the third condition, wherein the piston mandrel forces the ball out of the ball retention feature.

14. The ball dropping system of claim 1, wherein ball dropping system is configured to be disposed between a frac plug and a setting tool, the setting sleeve movable from the first position to the second position by the setting tool to set the frac plug.

15. A downhole assembly comprising:

a frac plug configured to receive a ball;

a setting tool configured to set the frac plug within an outer tubular; and, a ball dropping system disposed between the frac plug and the setting tool, the ball dropping system including:

a ball retention feature arranged to releasably secure the ball;

an ejection arrangement blocked from activating in a first condition of the ball dropping system, activatable in a second condition of the ball dropping system, and activated to eject the ball from the ball dropping system in a third condition of the ball dropping system; and, a setting sleeve movable from a first position to a second position with respect to the ejection arrangement, the setting sleeve having the first position to block the ejection arrangement from activating in the first condition of the ball dropping system, and the setting sleeve movable to the second position to render the ejection arrangement activatable in the second condition of the ball dropping system, and the setting sleeve movable from the first position to the second position by the setting tool.

16. The downhole assembly of claim 15, further comprising a perforation gun, wherein, upon firing the perforation gun, the ejection arrangement is activated by a fluid flow rate greater than a threshold flow rate, exteriorly of the ball dropping system in the third condition of the ball dropping system.

17. The downhole assembly of claim 15, wherein the ejection arrangement includes a first portion configured to engage with fluid flow exterior to the ball dropping system and an ejector configured to eject the ball from the ball retention feature.

18. A method of dropping a ball downhole, the method comprising:

running a ball dropping system in a first condition, the ball dropping system including a ball retention feature releasably securing the ball; an ejection arrangement configured to eject the ball from the ball dropping system; and a setting sleeve movable with respect to the ejection arrangement, the setting sleeve having a first position in the first condition in which the ejection arrangement is not activatable and the ball remains secured by the ball retention feature in the first condition of the ball dropping system;

moving the setting sleeve from the first position to a second position corresponding to a second condition of the ball dropping system, the ejection arrangement activatable in the second condition of the ball dropping system;

increasing flow rate exteriorly of the ball dropping system to activate the ejection arrangement; and, ejecting the ball in a third condition of the ball dropping system.

19. The method of claim 18, wherein the ball dropping system is disposed between a setting tool and a frac plug, and further comprising actuating the setting tool to move the setting sleeve, and moving the setting sleeve additionally sets the frac plug within an outer tubular.

20. The method of claim 18, further comprising firing a perforating gun to increase the flow rate and activate the ejection arrangement.

21. The method of claim 20, further comprising uncoupling the ball dropping system from the frac plug prior to firing the perforating gun.

* * * * *